US010519686B2

(12) United States Patent
Tate

(10) Patent No.: US 10,519,686 B2
(45) Date of Patent: Dec. 31, 2019

(54) SUPPORTING POST IMPROVEMENTS

(71) Applicant: Feral Pty Ltd., Maroochydore (AU)

(72) Inventor: Rodney James Tate, Maroochydore (AU)

(73) Assignee: Recycled Plastic Foundations Pty Ltd (AU)

( * ) Notice: Subject to any disclaimer, the term of this patent is extended or adjusted under 35 U.S.C. 154(b) by 33 days.

(21) Appl. No.: 15/747,204

(22) PCT Filed: Jul. 28, 2016

(86) PCT No.: PCT/AU2016/000264
§ 371 (c)(1),
(2) Date: Jan. 24, 2018

(87) PCT Pub. No.: WO2017/015694
PCT Pub. Date: Feb. 2, 2017

(65) Prior Publication Data

US 2018/0216360 A1 Aug. 2, 2018

(30) Foreign Application Priority Data

Jul. 28, 2015 (AU) ..... 2015902989

(51) Int. Cl.
*E04H 12/22* (2006.01)
*A45F 3/44* (2006.01)
(Continued)

(52) U.S. Cl.
CPC ..... *E04H 12/2223* (2013.01); *A45F 3/44* (2013.01); *E02D 5/74* (2013.01); *E02D 27/42* (2013.01);
(Continued)

(58) Field of Classification Search
CPC .... E02D 5/801; E04H 12/2223; E04H 12/223
See application file for complete search history.

(56) References Cited

U.S. PATENT DOCUMENTS 4,858,876 A 8/1989 Moreno
5,358,209 A * 10/1994 Ward ..... E04H 12/2223 248/530
(Continued)

FOREIGN PATENT DOCUMENTS

WO 2010/095961 A1 8/2010
WO 2010/127407 A1 11/2010

OTHER PUBLICATIONS

International Search Report dated Sep. 6, 2016 in connection with PCT/AU2016/000264.

*Primary Examiner* — Bradley Duckworth
(74) *Attorney, Agent, or Firm* — Akerman LLP

(57) ABSTRACT

A ground anchor assembly for quick and efficient installation into the ground, the assembly having a ground anchor post with a shaft with an upper end and lower end, the upper end having a threaded shaft section and the lower end having a helical blade portion, a rotating drive engaging end located on the upper end, a ground anchor post support device and a hollow main post wherein the hollow main post slidably engages the upper end of the ground anchor post when inserted into the ground and any lateral forces applied to the hollow main post is transferred out through to the ground anchor support device.

16 Claims, 6 Drawing Sheets

(51) Int. Cl.
*E02D 5/74* (2006.01)
*E02D 27/42* (2006.01)

(52) U.S. Cl.
CPC ..... *E04H 12/2253* (2013.01); *E04H 12/2276* (2013.01)

(56) References Cited

U.S. PATENT DOCUMENTS

| | | | | |
|---|---|---|---|---|
| 6,126,147 | A * | 10/2000 | Fingerson | E04H 12/2223 256/64 |
| 6,908,067 | B2 * | 6/2005 | Clasen | E04H 12/2223 248/533 |
| 7,942,377 | B2 * | 5/2011 | Harold | A45B 25/00 135/16 |
| 8,549,799 | B2 * | 10/2013 | Tate | A45F 3/44 52/156 |
| 8,631,627 | B2 * | 1/2014 | Atchley | E04H 12/2223 52/741.11 |
| 9,058,756 | B2 * | 6/2015 | Todd | G09F 15/0075 |
| 2004/0103599 | A1 | 6/2004 | Keck | |
| 2009/0180838 | A1 | 7/2009 | Ronnkvist | |
| 2011/0036025 | A1 | 2/2011 | Boulay | |
| 2018/0258602 | A1 * | 9/2018 | Kemp | E02D 5/56 |

* cited by examiner

SUPPORTING POST IMPROVEMENTS

This application is a national phase of PCT/AU2016/000264, filed Jul. 28, 2016, and claims priority to AU 2015902989, filed Jul. 28, 2015, the entire contents of both of which are hereby incorporated by reference.

FIELD OF THE INVENTION

The present invention relates to the installation of posts, and in particular a supporting post as well as a method of installing a supporting post in the ground using a post supporting bracket. The invention is also particularly directed to method and apparatus for installing and supporting a supporting post in soil so as to adequately stabilise and support the post.

BACKGROUND OF THE INVENTION

The problem to which this particular invention is directed relates to methods of installing posts into the ground.

The installation of in ground posts or ground anchoring systems for supporting posts is typically accomplished by the use of helical screw auger that create a hole in the ground into which is inserted a post. Soil or other supporting material is then backfilled around the post to provide lateral support. Such approaches are not often effective due to the surrounding soil conditions and also the lack of lateral support provided by the backfield around the post. This can be particularly problematic if the post is designed to be a load-bearing post, such as a strainer post.

An alternative method of installation involves the installation of a ground screw anchor into the soil, which once it has reached the appropriate depth is left in place with a fixing plate positioned slightly above ground level to which is attached the supporting post. A variation of this approach involves the insertion of the ground screw anchor below ground level and then attaching the supporting post to the ground screw anchor below ground level.

Whilst the above systems are considered to be generally suitable for their intended purpose, many of these systems fail to provide adequate lateral support to the supporting post particularly in unconsolidated soils or when the supporting post is subjected to high levels of strain.

SUMMARY OF THE INVENTION

According to the present invention there is a ground anchor assembly including a ground anchor post
- having a shaft with an upper end and lower end, the upper end having a threaded shaft section and the lower end having a helical blade portion, a rotating drive engaging end located on the upper end, a ground anchor post support device
- having an elongate inner sleeve section to receive the shaft of the ground anchor post there through, and an outer ground engaging surface, a hollow main post
- having an upper end and a lower end for slidably engaging the ground anchor post,
- wherein the hollow main post slidably engages the upper end of the ground anchor post when inserted into the ground and any lateral forces applied to the hollow main post is transferred out through to the ground anchor support device In preference, the hollow main post includes an outwardly extending flange stop located at the lower end.

In preference, the flange stop is a collar.

In preference, the collar abuts an upper surface of the ground anchor support device.

In preference, a self-leveling washer is located between the outwardly extending flange stop and the upper surface of the ground anchor support device.

In preference, the self-leveling washers are a pair of tapered washers.

In preference, the hollow main post includes an internal threaded section located at a lower end opening.

In preference, the internal threaded section is a tapered thread section.

In preference, the tapered thread section is welded into a lower end opening.

In preference, the ground anchor assembly further includes a coupling member to couple the hollow main post to the ground anchor post.

In preference, the coupling member is a locking nut having an inner thread portion.

In preference, the locking nut threadably engages with the threaded shaft of the ground engaging post.

In preference, the locking nut has a conical lower end to nestingly fit within the tapered thread section of the hollow main post.

In preference, the locking nut further includes a drive end to receive a rotating drive tool.

In preference, the conical lower end has an outer surface having an outer thread.

In preference, rotation of the locking nut then results in the engagement of the hollow main post with the ground anchor post.

In preference, the ground anchor post support device includes at least an upper flange and lower flange.

In preference, the upper flange and the lower flange define an upper face and a lower face.

In preference, the upper flange and lower flange have an outer ground engaging surface.

In preference, the ground engaging support device further includes an outer cylindrical body.

In preference, the outer cylindrical body has an inner surface and an outer surface.

In preference, the upper flange and lower flange of the ground anchor post support section abuts an interior surface of the outer cylindrical body.

In preference, the outer cylindrical body includes an inner lower support ledge to prevent the elongate inner sleeve section from passing through.

In preference, the ground engaging support device includes a plurality of radially extending support plates.

In preference, the plurality of radially extending support plates have an outer edges face that abuts the inner surface of the outer cylindrical body In preference, the coupling member includes a compressible ring positioned between the elongate inner sleeve section of the ground anchor support device and an outer surface of the hollow main post.

BRIEF DESCRIPTION OF THE DRAWINGS

By way of example, an embodiment of the invention is described more fully hereinafter with reference to the accompanying drawings, in which.

DETAILED DESCRIPTION OF THE INVENTION

Figure 3:
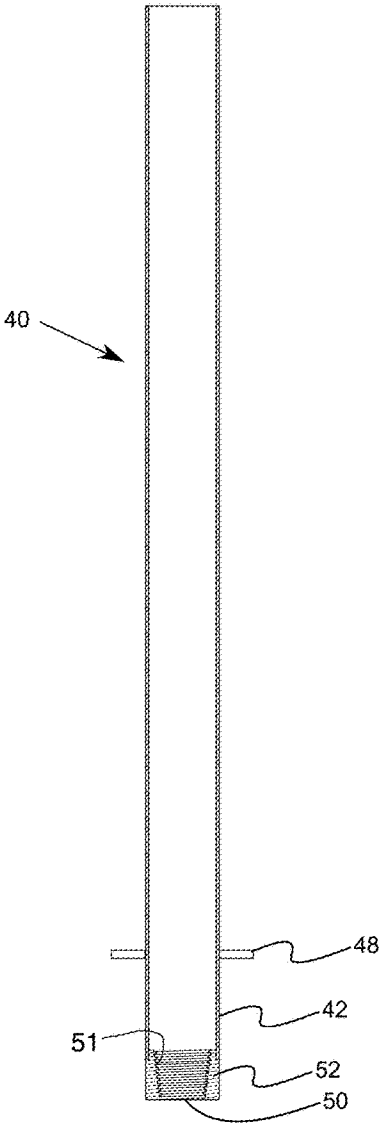
FIG. 3 is a side sectional view of the main post of FIG. 2.
Figure 2:
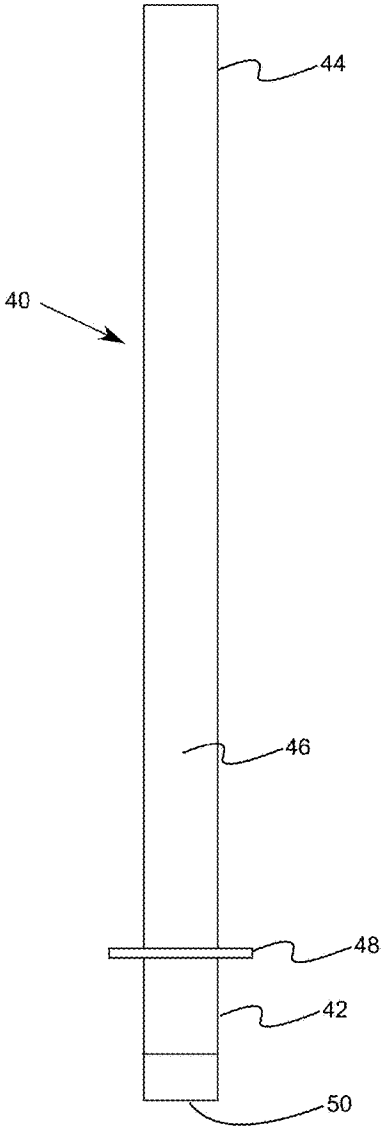
FIG. 2 is a side view of the outer main post.
Figure 1:
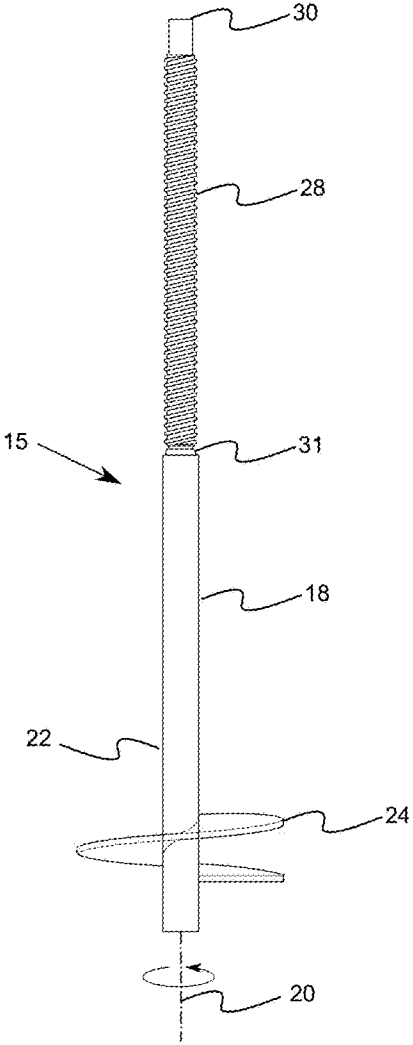
FIG. 1 is a side view of the ground anchor post of the present invention.
Figure 7:
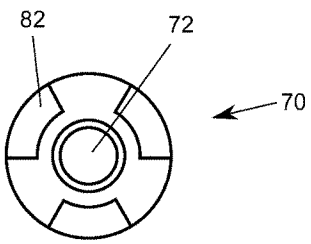
FIG. 7 is a top view of the lock nut of FIG. 5.
Figure 6:
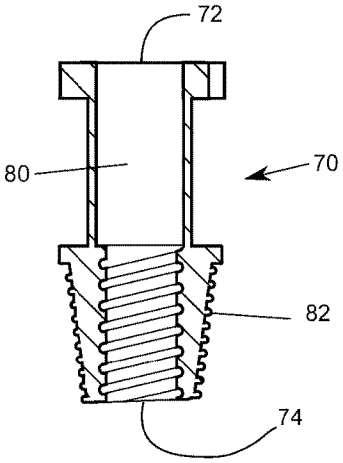
FIG. 6 is a side sectional view of the lock nut of FIG. 5.
Figure 5:
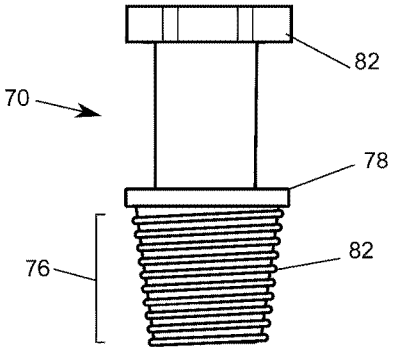
FIG. 5 is a side view of the lock nut.
Figure 4:
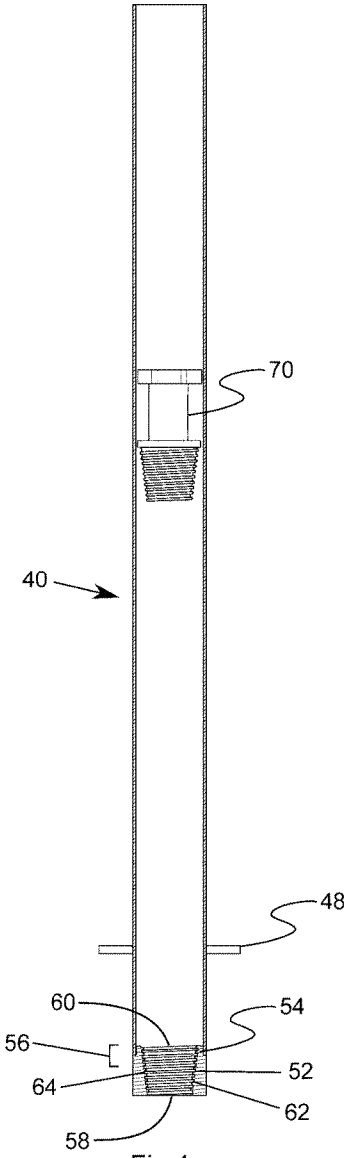
FIG. 4 is a is a side sectional view of the main post of FIG. 2 with the lock nut inserted inside.
Figure 8:
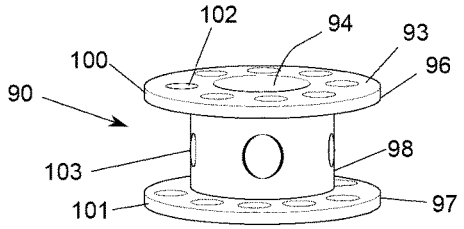
FIG. 8 is a perspective view of the ground anchor support device.
Figure 9:
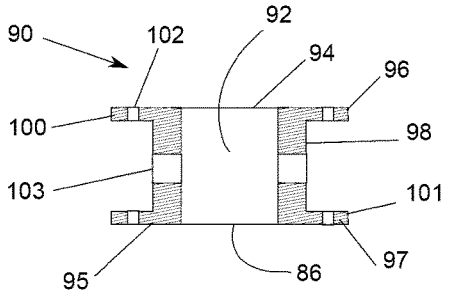
FIG. 9 is a side section view of the ground anchor support device of FIG. 8.
Figure 9A:
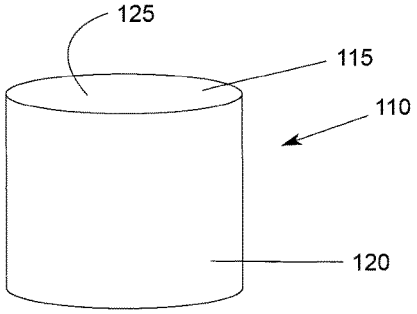
FIG. 9*a* is a perspective view of the outer cylindrical body to be used with the ground anchor support device.
Figure 9B:
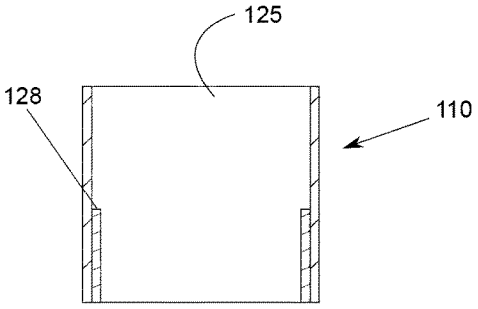
FIG. 9*b* is a cross section view of FIG. 9*a;*
Figure 10:
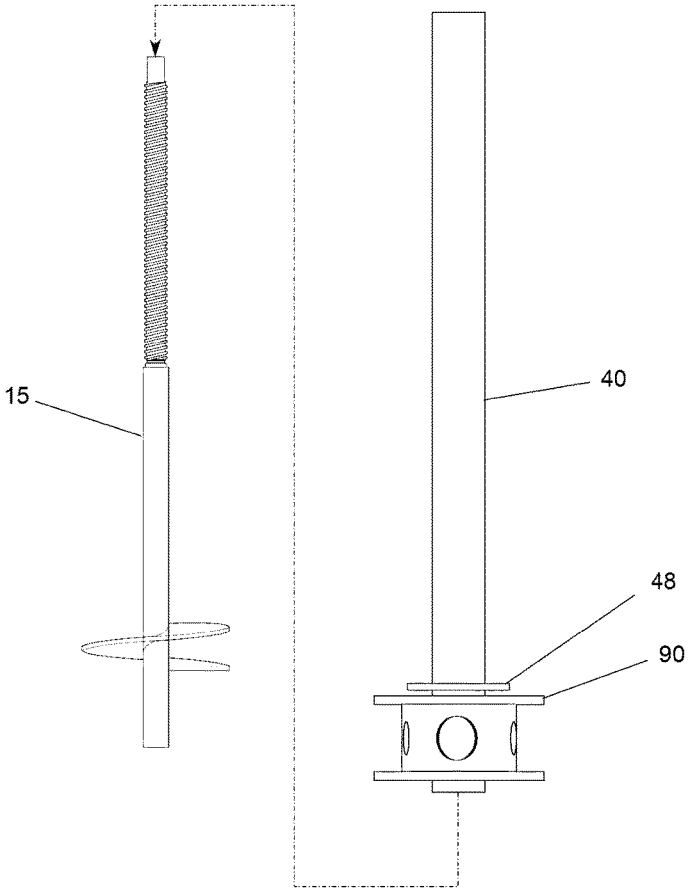
FIG. 10 is a view showing the assembly of the ground anchor post and the outer main post.
Figure 11:
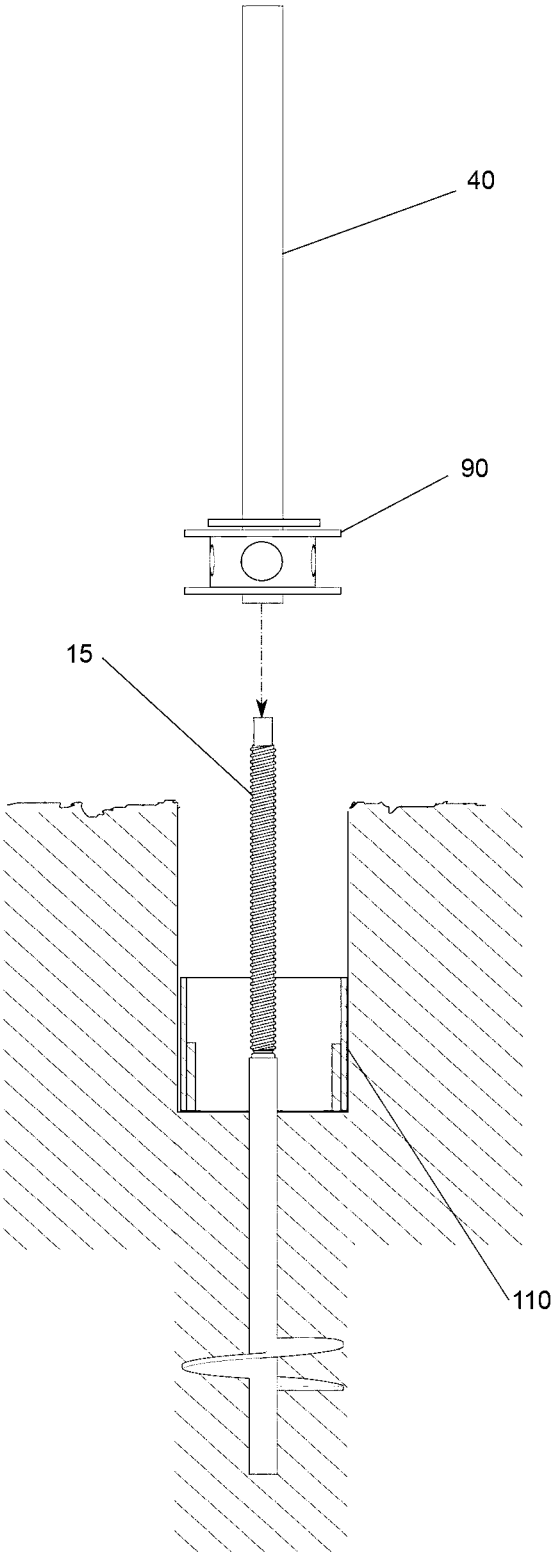
FIG. 11 is a cross sectional view of the assembly of the ground anchor post and the outer main post in the ground.
Figure 12:
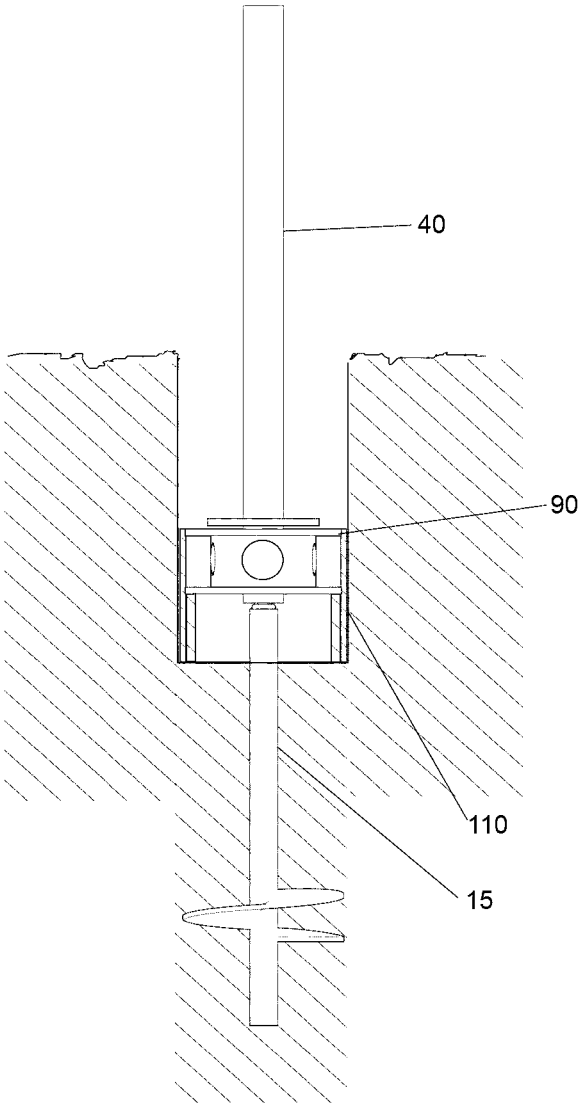
FIG. 12 is a cross section view of the assembly of FIG. 11 with a partial full view showing the interaction of the ground anchor support device with the outer cylindrical body.
Figure 13:
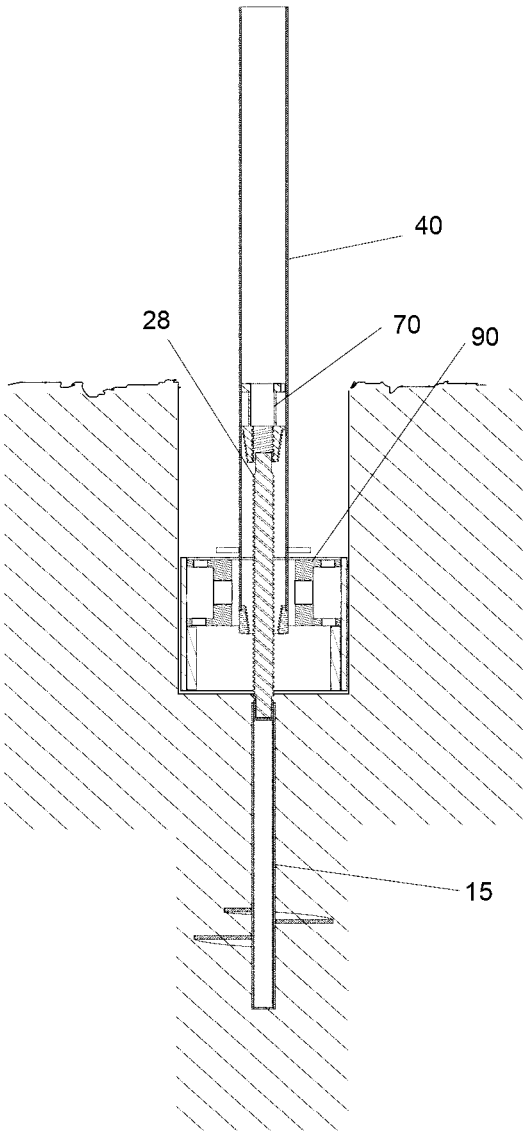
FIG. 13 full side section view of FIG. 12.
Figure 14:
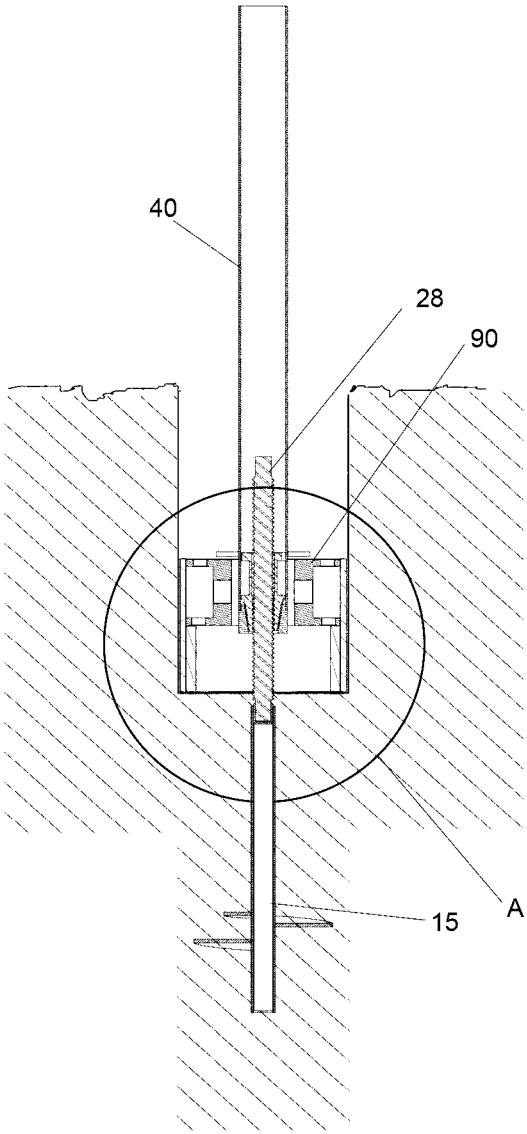
FIG. 14 is the side section view of FIG. 13 with the lock nut engaging the threaded cap section of the hollow main post.
Figure 15:
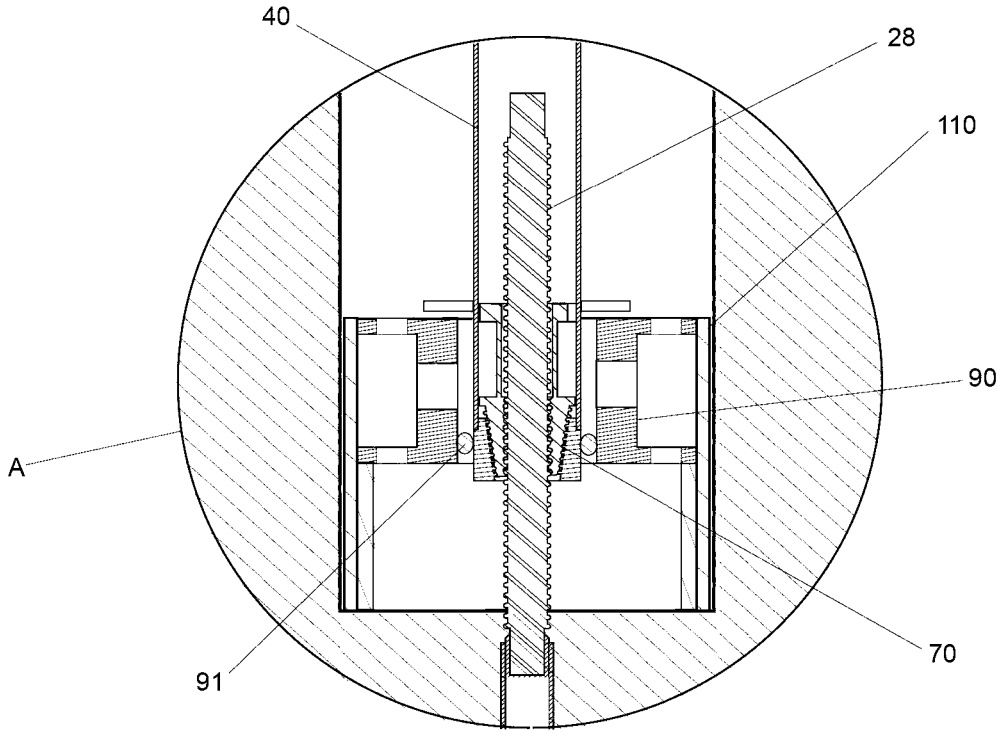
FIG. 15 is a close up side section view of the section A from FIG. 14.

The methods and devices in accordance with the present invention are intended for use with helical anchors, commonly referred to as ground anchors, and are used to support above ground fixtures, such as posts, in soils, and especially loose, unconsolidated or reactive soils although use in other soil types may also be achieved.

The ground anchor assembly 10 has a ground anchor post 15 with a shaft 18 with a longitudinal axis 20. At the lower end 22 of the shaft 18 is a helical blade portion 24, commonly referred to as an auger. The upper end 26 has a threaded shaft section 28 and a rotating drive engaging in 30. The rotating drive engaging end 30 has a hexagonal shape to enable it to be coupled to a drive means to effect rotation of the shaft 18. Alternative shapes of the rotating drive engaging and 30 may be employed in order to ensure effective coupling with a rotating drive mains.

The threaded shaft section 28 extends substantially along the longitudinal length of the shaft 18 terminating at endpoint 30. The length of the threaded shaft section may be greater or shorter than that shown in the figures without deviating from the scope of the invention.

The hollow main post 40 comprises a circular hollow section steel length having a lower end 42 and an upper end 44. The outer surface 46 is substantially circular and located on the low end 42 is a flange stop 48, which projects substantially perpendicular to the outer surface 46. The lower end 42 has a low end opening 50 in which there is an internally threaded section 51, which is created by the insertion of the section 52 which is substantially circular and has a ledge 54 extending about the upper section 56.

The section 52 has an opening 58 at one end and another opening 60 at an opposite end. In between the openings 58 and 60 there is a comical or tapered inner wall 62, which has an internal thread 64. The section 52 is inserted into the lower end opening 50 of the hollow main post 40 and may be welded in place to secure it. The opening 58 of the section 52 is of sufficient diameter to enable the insertion of the shaft 18 of the ground anchor post 15.

The coupling means 70 is a locking nut having an inner passage 72 having an inner thread portion 74, a conical lower end 76 and a peripheral flange 78. The inner thread portion 74 extends up along the inner of the conical lower end 76, however, as required, the inner thread portion may extend into the in a passage section 80. The outer surface 82 of the conical lower end 76 can be smooth or alternatively have an external thread to provide engagement with the internal thread 64 of the section 52. The coupling means 70 has a drive end 82 shaped to receive a rotatable driving tool so as to be able to rotate the coupling means 70. The shape of the drive and 82 can be altered in order to accommodate the appropriate rotating driving means.

The ground anchor support device 90 has an elongate inner sleeve section 92 with an upper opening 94 and a lower opening 86. Extending outward and away from the elongate inner sleeve section 92 are the flange sections 96 and 97 respectively. The outer surface 98 of the ground anchor support device can be the outer ground engaging surface, once inserted into the ground. Alternatively, at the outermost peripheral sections 100 and 101 of the flange members 96 and 97 there can be an outer projecting ground engaging surface.

The outer cylindrical body 110 has an inner surface 115 and an outer surface 120. The ground anchor support device 90 can be inserted into the opening 125 of the outer cylindrical body 110 such that the lower face 95 of the ground anchor support device can abut or rest on the inner flange 128 of the outer cylindrical body 110. If required the ground anchor support device 90 and the outer cylindrical body 110 can be affixed to one another, for example by glue. Alternatively, the assembly can be manufactured in a modular manner.

The upper face 93 and lower face 95 can have a plurality of openings 102 thereon so that once it has been inserted into the outer cylindrical body 110 material placed on the upper face can flow between the flanges 96 and 97. Openings 103 can also be made in the outer surface 98 to further allow for the distribution of material poured into it. This is useful if, for example, backfill or quick drying cement is used in order to strengthen the ground anchor support device.

Alternatively, the ground anchor support device can have an elongate inner sleeve section with a plurality of radially extending support members that about the inner surface 115 of the outer cylindrical body 110. Again, the radially extending supporting members may be into integrally manufactured with the outer cylindrical body 110. Either way, the flanges 96 and 97 or the radially extending support members provide support to the outer cylindrical body 110 when it is installed in the ground.

As the blade portion 24 rotates, it pulls the post 15 down into the ground and once at the required depth the rotating means driving the and could post is removed from the rotating drive engaging end 30. A ground anchor support device 90 is then inserted over the shaft 18 of the ground and could post 15 and rests upon the ground around the ground anchor post 15. Supports may be used underneath the ground anchor support device 90 if required in order to supported however in most instances these are not required. A hollow main post 40 is then taken and inserted over the shaft 18 until the flange stop 48 contacts the upper face 93 of the ground and can support device 90.

If required, a self leveling washer assembly may be inserted between the ground anchor support device 90 and the hollow main post 40. The flange stop 48 of the hollow main post 40 within rest upon the self leveling assembly. The lower end 42 of the hollow main post 40, as it is inserted into the elongate in a section 92 and a compression ring 91 may be used to help stabilise the hollow main post 40 within the inner sleeve section 90.

The coupling means 70 on the threaded shaft section 28 is then screwed down into place by a suitably shaped driving means attached to the drive end 82. The threads on the conical lower end 76 then eventually engage with the inner threads 64 on the tapered comical in wall 62 until it is as tight as required. This then in effect locks or holds the out of post 40 to the ground anchor post 15. The area around the post can then be backfilled with dirt or quick setting concrete so as to provide further stabilisation of the post.

In this arrangement then any lateral force applied to the external hollow main post 40 is translated directly into the ground anchor support device and into the surrounding soil area thus providing exceptional resistance to any applied lateral force. The ground anchor support device 90 can have a plurality of openings on its upper face so as to allow material, such as dirt or cement, to pass through the flange section 96 and into the opening immediately below. If the soil is considered to be very loose then the ground anchor support device 90 can be used in conjunction with and outer cylindrical body 110 so as to provide additional soil surface area contact.

The assembly/device/method of the present invention provides a quick and efficient method to install a fence post or ground anchor into the ground compared to more traditional methods and assemblies/devices. This saves time and effort thus reducing the overall costs of installation whilst providing a system that is able to withstand greater lateral forces compared to commonly used systems.

The invention claimed is:

1. A ground anchor assembly including a ground anchor post having a shaft with an upper end and lower end, the upper end having a threaded shaft section and the lower end having a helical blade portion, a rotating drive engaging end located on the upper end, a ground anchor post support device having an elongate inner sleeve section to receive the shaft of the ground anchor post there through, and an outer ground engaging surface, a hollow main post having an upper end and a lower end for slidably engaging the ground anchor post, wherein the hollow main post slidably engages the upper end of the ground anchor post when inserted into the ground;

wherein the hollow main post includes an internal threaded section located at a lower end opening;

wherein the internal threaded section is a tapered thread section and is welded into a lower end opening.

2. The ground anchor assembly of claim 1, wherein the hollow main post includes an outwardly extending flange stop located at the lower end.

3. The ground anchor assembly of claim 2, wherein the flange stop is a collar.

4. The ground anchor assembly of claim 3, wherein the collar abuts an upper surface of the ground anchor post support device.

5. The ground anchor assembly of claim 1, wherein the ground anchor assembly further includes a coupling member to couple the hollow main post to the ground anchor post.

6. The ground anchor assembly of claim 5, wherein the coupling member is a locking nut having an inner thread portion.

7. The ground anchor assembly of claim 6, wherein the locking nut at least one of threadably engages with the threaded shaft of the ground anchor post or has a conical lower end to nestingly fit within the tapered thread section of the internal threaded section of the hollow main post.

8. The ground anchor assembly of claim 7, wherein, the locking nut further includes a drive end to receive a rotating drive tool.

9. The ground anchor assembly of claim 7, wherein the conical lower end has an outer surface having an outer thread.

10. The ground anchor assembly of claim 6, wherein, rotation of the locking nut then results in the engagement of the hollow main post with the ground anchor post.

11. The ground anchor assembly of claim 5, wherein the coupling member includes a compressible ring positioned between the elongate inner sleeve section of the ground anchor post support device and an outer surface of the hollow main post.

12. The ground anchor assembly of claim 1, wherein the ground anchor post support device includes at least an upper flange and lower flange, and wherein the upper flange and the lower flange define an upper face and a lower face.

13. The ground anchor assembly of claim 12, wherein the upper flange and lower flange have an outer projecting ground engaging surface.

14. The ground anchor assembly of claim 13, wherein the ground anchor assembly further includes an outer cylindrical body.

15. The ground anchor assembly of claim 14, wherein the outer cylindrical body has an inner surface and an outer surface, and wherein the upper flange and lower flange of the ground anchor post support device abuts an interior surface of the outer cylindrical body.

16. The ground anchor assembly of claim 15, wherein the outer cylindrical body includes an inner lower support ledge to prevent the elongate inner sleeve section from passing through the outer cylindrical body.

* * * * *